US010138663B2

(12) United States Patent
Ando

(10) Patent No.: US 10,138,663 B2
(45) Date of Patent: Nov. 27, 2018

(54) LOCKING DEVICE FOR A TONER CONTAINER AND IMAGE FORMING APPARATUS HAVING THE LOCKING DEVICE

(71) Applicant: KYOCERA Document Solutions Inc., Osaka (JP)

(72) Inventor: Satoshi Ando, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/850,580

(22) Filed: Dec. 21, 2017

(65) Prior Publication Data

US 2018/0179796 A1 Jun. 28, 2018

(30) Foreign Application Priority Data

Dec. 22, 2016 (JP) ..... 2016-249285

(51) Int. Cl.

| | |
|---|---|
| ***G03G 15/00*** | (2006.01) |
| ***G03G 15/08*** | (2006.01) |
| ***E05C 19/06*** | (2006.01) |
| ***G03G 21/16*** | (2006.01) |

(52) U.S. Cl.

CPC ..... *E05C 19/06* (2013.01); *G03G 21/1633* (2013.01); *G03G 21/1647* (2013.01); *G03G 21/1676* (2013.01); *G03G 2221/163* (2013.01); *G03G 2221/1654* (2013.01)

(58) Field of Classification Search

CPC ..... G03G 15/0865; G03G 15/0877; G03G 21/1633; G03G 21/1647; G03G 21/1676

USPC ..... 399/110, 258

See application file for complete search history.

(56) References Cited

U.S. PATENT DOCUMENTS

| | | | | |
|---|---|---|---|---|
| 7,974,558 | B2 * | 7/2011 | Choi et al. | G03G 15/0877 399/258 |
| 8,358,953 | B2 * | 1/2013 | Itabashi | G03G 21/1676 399/110 |
| 9,921,542 | B2 * | 3/2018 | Mochizuki et al. | G03G 21/1676 |

FOREIGN PATENT DOCUMENTS

| | | |
|---|---|---|
| JP | 9-171290 | 6/1997 |

* cited by examiner

*Primary Examiner* — William J Royer

(74) *Attorney, Agent, or Firm* — Wenderoth, Lind & Ponack, L.L.P.

(57) ABSTRACT

A locking device includes a locking cover that is opened and closed when a toner container is attached and detached, an engagement part that is engaged with the locking cover in a closed state, a tension member that pulls the engagement part, thereby allowing the engagement part to be engaged with the locking cover, a movement part that moves the engagement part in an opposite direction to release an engagement state between the engagement part and the locking cover, and a mounting member that is mountable at an image forming apparatus body at two postures, and limits movement of the movement part in the opposite direction to maintain the engagement state when the mounting member is mounted at one posture while permitting the movement of the movement part in the opposite direction to allow the engagement state to be releasable when the mounting member is mounted at the other posture.

4 Claims, 11 Drawing Sheets

LOCKING DEVICE FOR A TONER CONTAINER AND IMAGE FORMING APPARATUS HAVING THE LOCKING DEVICE

CROSS-REFERENCE TO RELATED APPLICATION

This application is based upon and claims the benefit of priority from Japanese Patent Application No. 2016-249285 filed on Dec. 22, 2016, the entire contents of which are incorporated herein by reference.

BACKGROUND

The technology of the present disclosure relates to a locking device and an image forming apparatus.

For example, there has been known a developer replenishing case detachable to a developer receiving device including a developer receiving case, a developer receiving opening, a part to be inserted, a slide type device opening/closing lid, and a locking member. The aforementioned developer replenishing case has a case body, a developer replenishing opening, a sealing sheet for sealing the developer replenishing opening to be openable, a protruding part protruding from the case body, and protrusions provided at one lateral side and the other lateral side of the case body and protruding at an opposite side of the case body, wherein the protruding part is inserted into the part to be inserted when the developer replenishing case is mounted at the developer receiving device and the protrusions are engaged with the locking member of the developer receiving device to move the locking member to a locking release position when the developer replenishing case is mounted at the developer receiving device. That is, the locking member of the aforementioned developer replenishing case is for suppressing leakage of a developer.

SUMMARY

A locking device according to one aspect of the present disclosure includes a locking cover, an engagement part, a tension member, a movement part, and a mounting member. The locking cover is opened and closed when a toner container for receiving toner to be replenished to a development device for developing a toner image is attached to and detached from an image forming apparatus body. The engagement part is engaged with the locking cover when the locking cover is in a closed state. The tension member pulls the engagement part from a prescribed direction, thereby allowing the engagement part to be engaged with the locking cover. The movement part moves the engagement part in an opposite direction of the prescribed direction, thereby releasing an engagement state between the engagement part and the locking cover. The mounting member is mountable at the image forming apparatus body at two postures, and limits movement of the movement part in the opposite direction so as to maintain the engagement state when the mounting member is mounted at one posture while permitting the movement of the movement part in the opposite direction so as to allow the engagement state to be releasable when the mounting member is mounted at a remaining one posture.

An image forming apparatus according to one aspect of the present disclosure includes the locking device, a formation unit that includes a development device for developing a toner image and forms the toner image on a medium, a toner container that receives toner to be replenished to the development device, and a fixing device that fixes the toner image, which is formed on the medium, to the medium.

DETAILED DESCRIPTION

«Overview»

Figure 1:
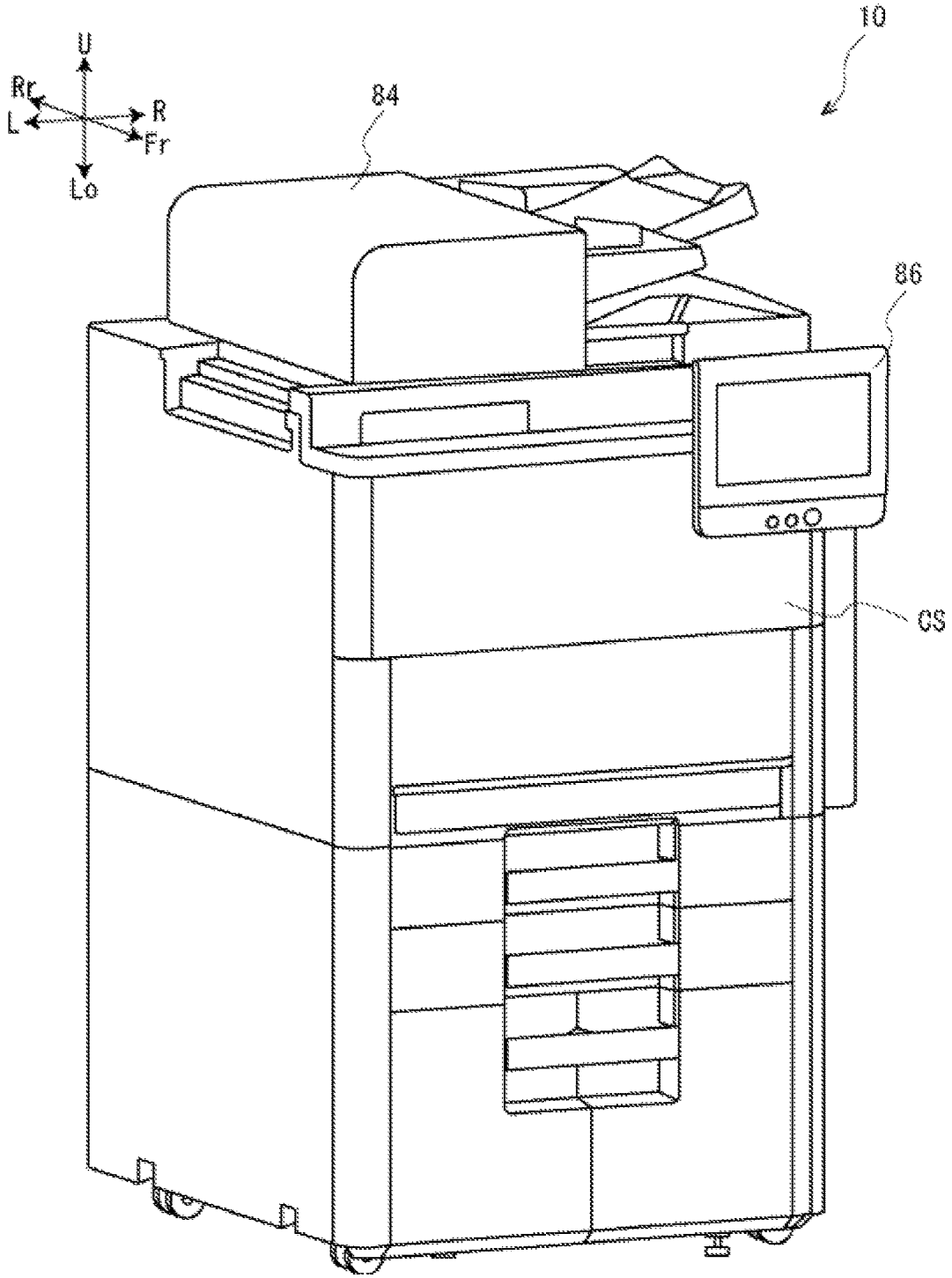
FIG. 1 is a perspective view of an image forming apparatus of the present embodiment.

Hereinafter, an overall configuration of an image forming apparatus 10 (see FIG. 1 and FIG. 2) of the present embodiment, an operation of the image forming apparatus 10, a configuration and an operation of a locking device 90 (see FIG. 4 to FIG. 9), which is a main element of the present embodiment, and effects of the present embodiment will be described in the order of mention with reference to the drawings.

In the following description, it is assumed that directions indicated by an arrow Fr and an arrow Rr are respectively apparatus depth direction front side and depth side, directions indicated by an arrow R and an arrow L are respectively apparatus width direction right side and left side, and directions indicated by an arrow U and an arrow Lo are respectively apparatus height direction upper side and lower side in the drawings. In the present specification, a state, in which the image forming apparatus 10 is viewed from the apparatus depth direction front side, is assumed to be a front surface of the image forming apparatus 10.

«Overall Configuration of Image Forming Apparatus»

Figure 2:
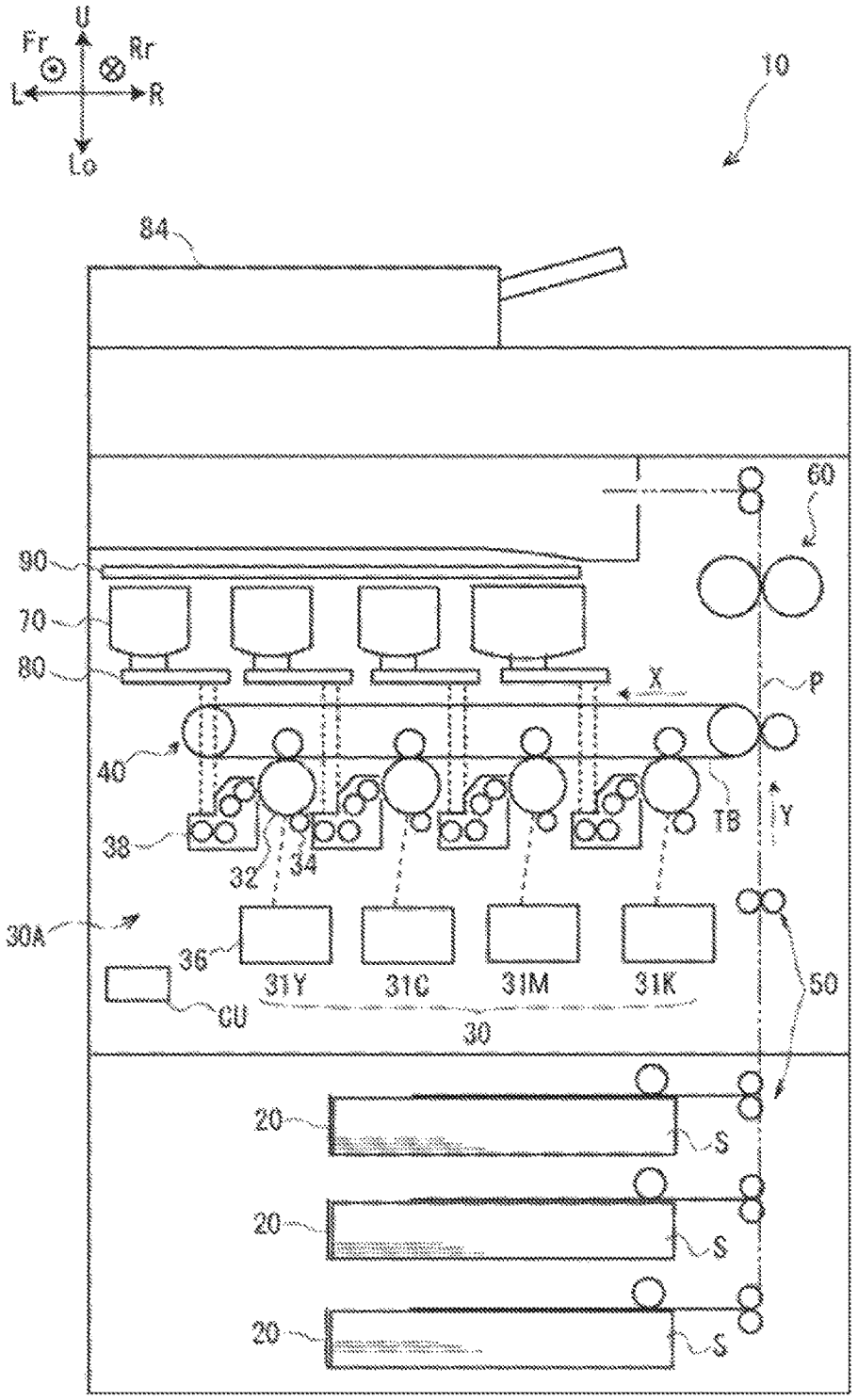
FIG. 2 is a schematic view when an image forming apparatus of the present embodiment is viewed from a front side.
Figure 3:
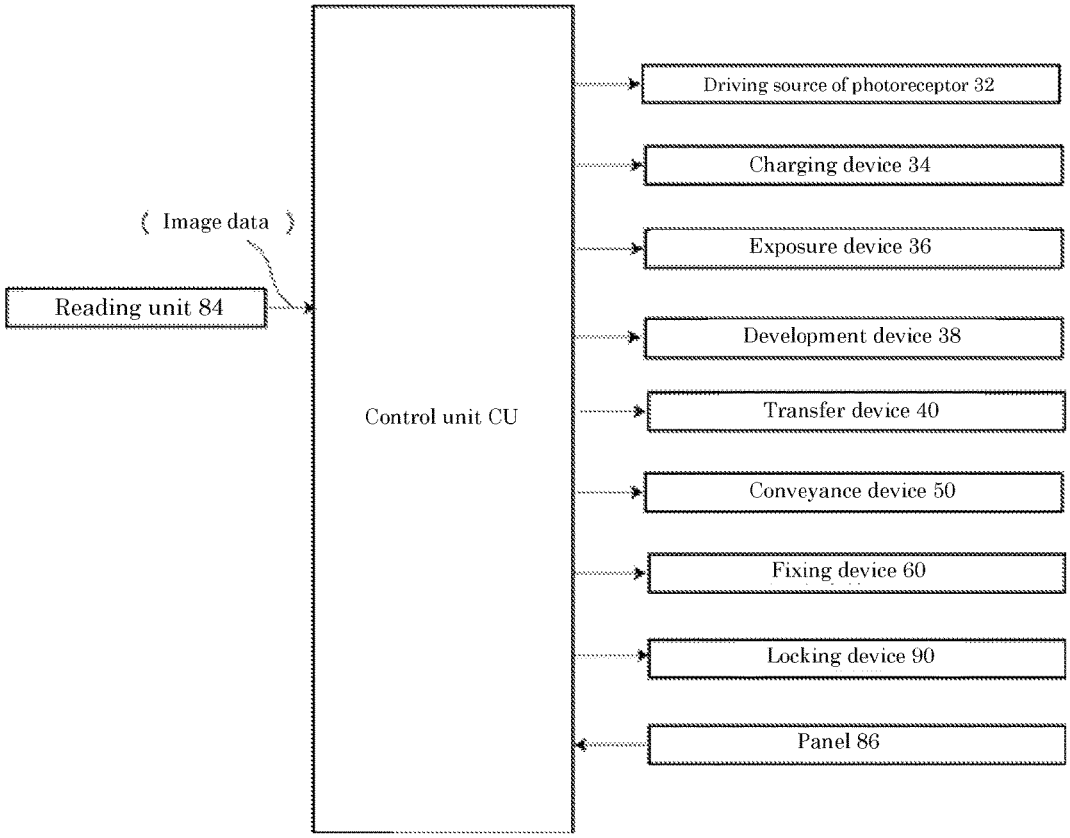
FIG. 3 is a block diagram illustrating a relation between a control unit constituting an image forming apparatus of the present embodiment and each element constituting the image forming apparatus.

As illustrated in FIG. 2, the image forming apparatus 10 is an electrophotographic apparatus including sheet feeding cassettes 20, a toner image formation unit 30, a transfer device 40, a conveyance device 50, a fixing device 60, a toner container 70, a toner conveyance unit 80, a reading unit 84, a panel 86, a locking device 90, and a control unit CU.

The sheet feeding cassettes 20 have a function of receiving a medium S. The sheet feeding cassettes 20 are arranged at a lower side of the image forming apparatus 10 in the apparatus height direction.

The toner image formation unit 30 has a function of forming a toner image held by a belt TB (which will be described later) by performing each process of charging, exposure, and development. The toner image formation unit 30 includes monochromatic units 31Y, 31M, 31C, and 31K that form toner images of colors (Y (yellow), C (cyan), M (magenta), and K (black)) different from one another. Each of the monochromatic units 31Y, 31M, 31C, and 31K includes a photoreceptor 32 (an example of a carrying member), a charging device 34, an exposure device 36, and a development device 38. The development device 38 is configured to develop a latent image, which is formed on the photoreceptor 32 by the exposure device 36, as a toner image by using a developer including toner (not illustrated) and carrier (not illustrated). Furthermore, the toner image formation unit 30 is arranged at a center of the image forming apparatus 10 in the apparatus height direction.

The transfer device 40 has the belt TB having an endless shape and has a function of primarily transferring the toner image formed by the toner image formation unit 30 on the belt TB circularly moving (in an arrow X direction of FIG. 2) and secondarily transferring the toner image held on the belt TB to the medium S. The transfer device 40 is arranged at the center of the image forming apparatus 10 in the apparatus height direction and above the toner image formation unit 30. It can be said that the transfer device 40 has a function of forming the toner image on the medium S together with the toner image formation unit 30. In this regard, in the present specification, a combination of the toner image formation unit 30 and the transfer device 40 is called a formation unit 30A.

The conveyance device 50 has a function of conveying the medium S received in the sheet feeding cassettes 20 along a conveyance path (a two dot chain line P of FIG. 2). In FIG. 2, an arrow Y indicates a conveyance direction of the medium S.

The fixing device 60 has a function of fixing the toner image, which have been secondarily transferred to the medium S by the transfer device 40, to the medium S. The fixing device 60 is arranged above the transfer device 40 in the apparatus height direction and at the right side when the image forming apparatus 10 is viewed from the front side.

The toner container 70 has a function of receiving toner to be replenished to the development device 38. The toner container 70 includes toner containers 70Y, 70C, 70M, and 70K, and is provided to each toner of the colors (Y (yellow), C (cyan), M (magenta), and K (black)) different from one another. Each toner container 70 serves as a long case having the developer therein and is arranged above the transfer device 40 in a state in which its longitudinal direction is allowed to be along the apparatus depth direction and is disposed along the apparatus width direction. As an example, each toner container 70 is detachable to the body of the image forming apparatus 10. That is, each toner container 70 serves as exchange parts in the image forming apparatus 10. The toner conveyance unit 80 has a function of conveying the toner in each toner container 70 to the development device 38.

The reading unit 84 has a function of reading an image and converting the image into image data. The reading unit 84 is arranged above the fixing device 60 as illustrated in FIG. 1 and FIG. 2.

The panel 86 is so-called a touch panel, and serves as a user interface for inputting image formation conditions and the like when a user operates the image forming apparatus 10.

The locking device 90 has a function of allowing each toner container 70 to be in a state (an unlocked state) of being detachable from the image forming apparatus 10 and a state (a locked state) of being non-detachable. The locking device 90 will be described later.

When the toner image formation unit 30 is operated, the charging device 34 charges the photoreceptor 32, the exposure device 36 exposes the photoreceptor 32, and the development device 38 develops a latent image of the photoreceptor 32 as a toner image in each of the monochromatic units 31Y, 31M, 31C, and 31K. As a consequence, the toner image is formed on each photoreceptor 32.

Figure 4:
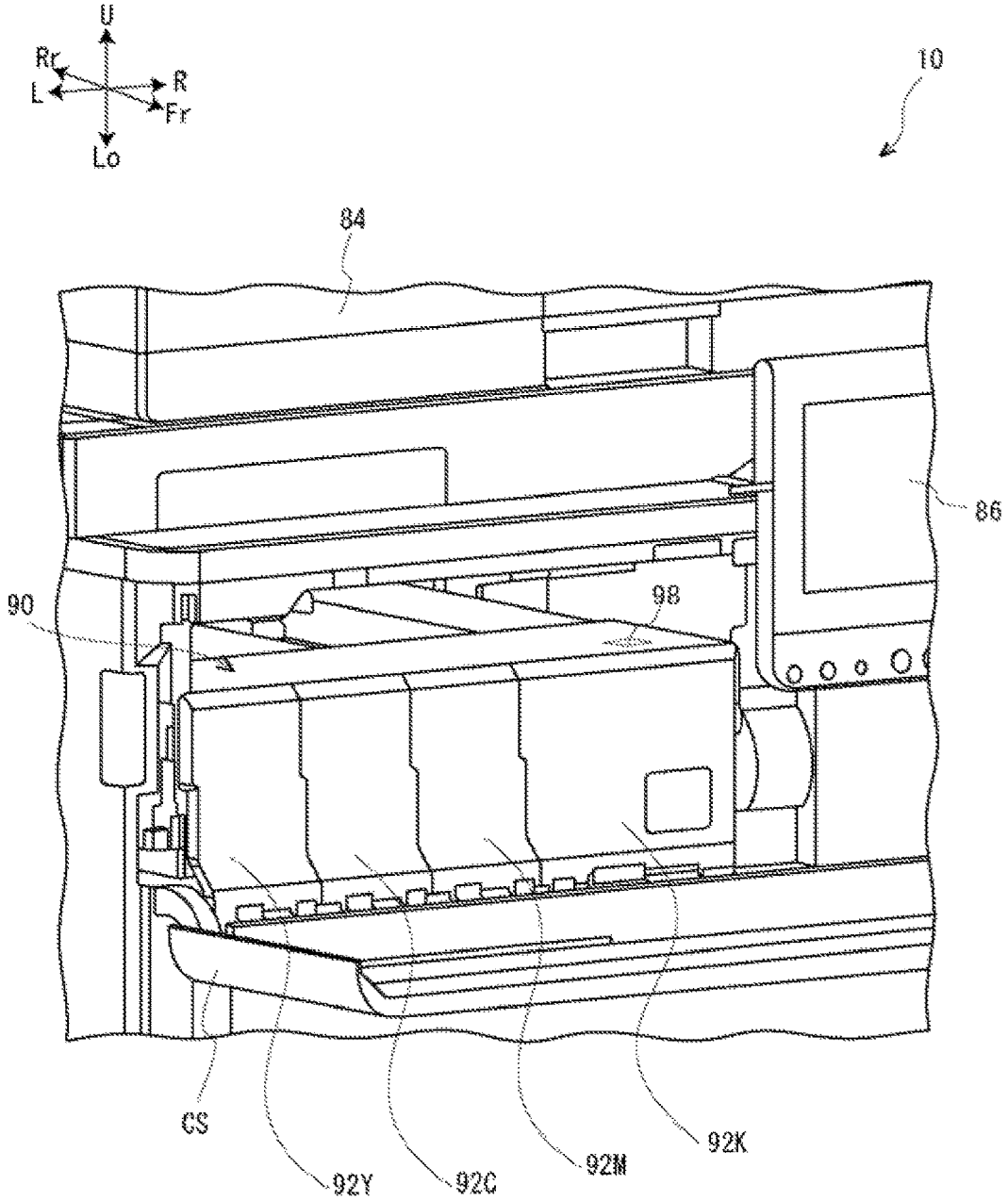
FIG. 4 is a view illustrating a periphery of a locking device constituting an image forming apparatus of the present embodiment and is a perspective view of a state in which an exterior cover is opened and a locking cover is closed.
Figure 10:
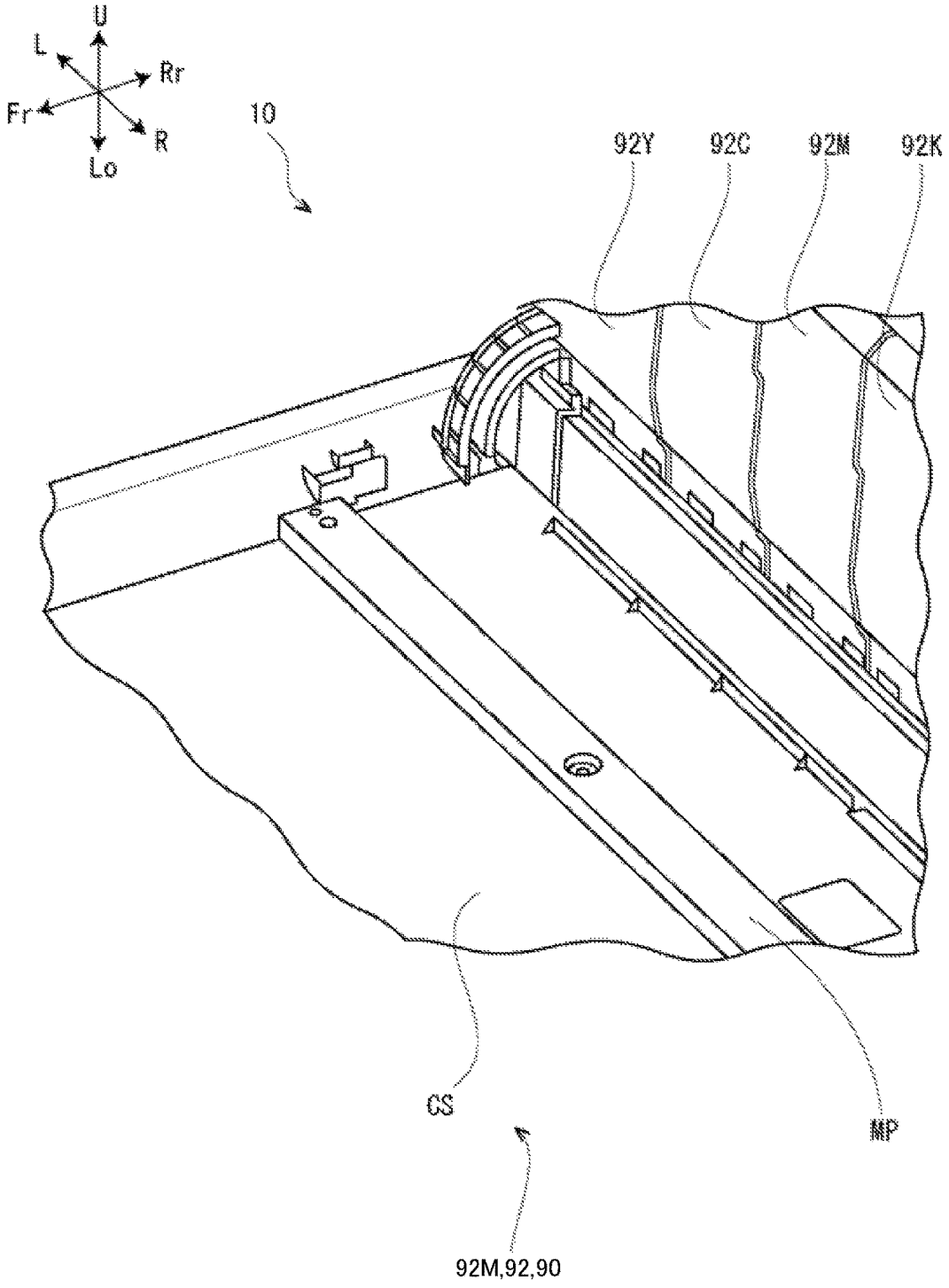
FIG. 10 is view of an exterior cover constituting an image forming apparatus of the present embodiment and is a perspective view illustrating a state in which the exterior cover is opened.

The image forming apparatus 10 is provided at the front side thereof with an exterior cover CS that is opened by falling to the front side (see FIG. 1 and FIG. 4). The exterior cover CS serves as a lid that is opened and closed when the toner container 70 is attached to and detached from the image forming apparatus body. As illustrated in FIG. 10, a long sheet metal MP is fixed to a rear surface of the exterior cover CS in a range across the apparatus width direction. The sheet metal MP is a magnetic material as an example.

«Image Forming Operation»

Next, the image forming operation of the image forming apparatus 10 of the present embodiment will be described with reference to FIG. 2.

The control unit CU having received image data from the reading unit 84 operates each element of the image forming apparatus 10.

When the toner image formation unit 30 is operated, the charging device 34 charges the photoreceptor 32, the exposure device 36 exposes the photoreceptor 32, and the development device 38 develops a latent image of the photoreceptor 32 as a tone image in each of the monochromatic units 31Y, 31M, 31C, and 31K. As a consequence, the toner image is formed on each photoreceptor 32.

Next, when the transfer device 40 and the conveyance device 50 are operated, the toner image formed by the toner image formation unit 30 is primarily transferred to the belt TB. The medium S received in the sheet feeding cassettes 20 is conveyed by the conveyance device 50 in accordance with a timing at which the toner image primarily transferred to the belt TB is secondarily transferred, so that the toner image held on the belt TB is secondarily transferred to the medium S. The medium S with the secondarily transferred toner image is conveyed toward the fixing device 60 by the conveyance device 50.

Next, when the fixing device 60 is operated and the medium S with the secondarily transferred toner image is conveyed to the fixing device 60, the toner image secondarily transferred to the medium S is fixed to the medium S (an image is formed on the medium S).

Then, the medium S with the fixed toner image (the medium S with the formed image) is discharged outside the image forming apparatus 10 by the conveyance device 50, so that the image forming operation is ended.

«Configuration of Main Element (Locking Device)»

Next, the configuration of the locking device 90, which is a main element of the present embodiment, will be described in detail with reference to FIG. 4 to FIG. 9.

Figure 6:
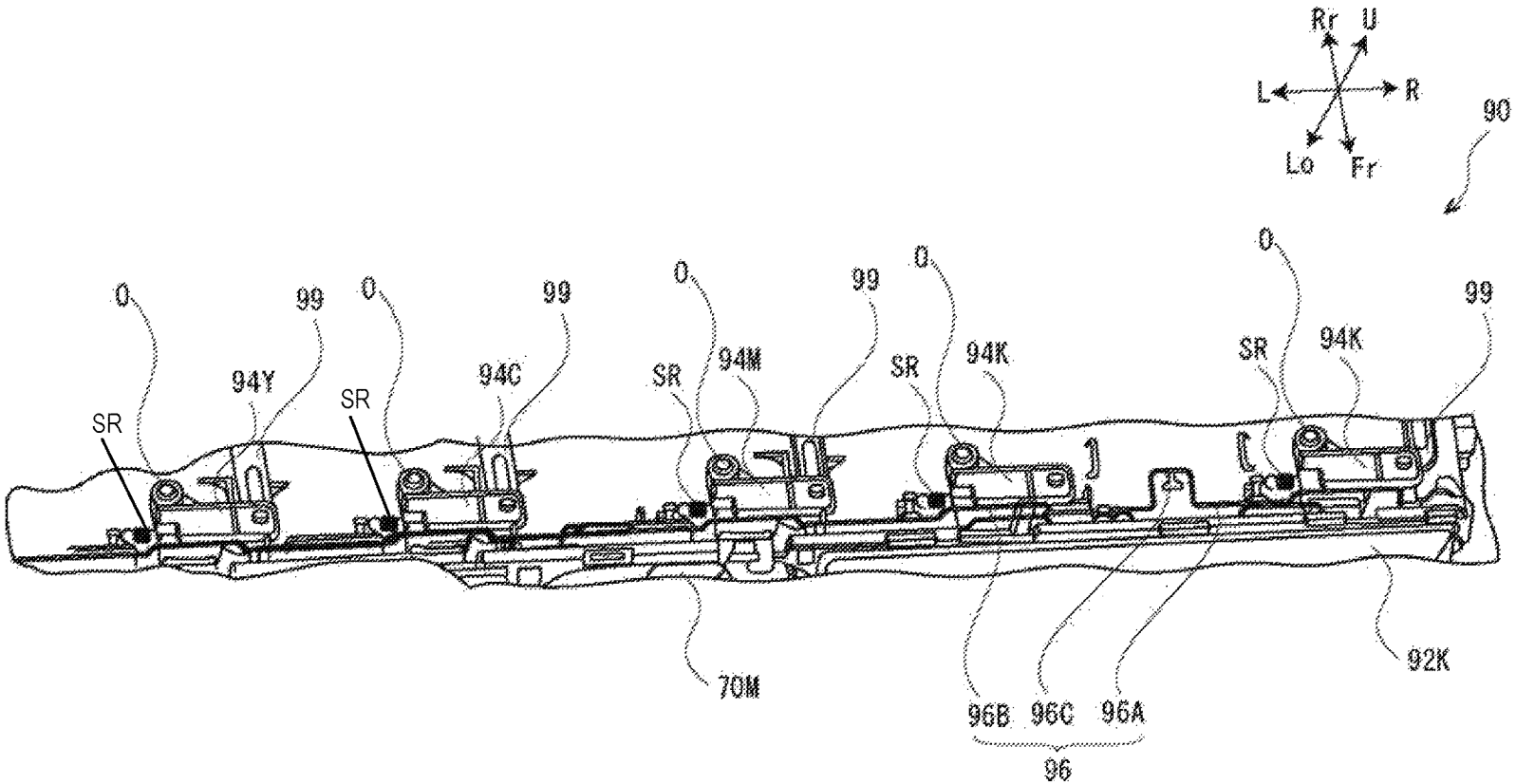
FIG. 6 is a view of a locking device of the present embodiment and is a perspective view illustrating a periphery of an engagement part and a movement part.

The locking device 90 includes locking covers 92Y, 92C, 92M, and 92K (see FIG. 4 and the like), engagement parts 94Y, 94C, 94M, and 94K (see FIG. 6), a tension spring SR (an example of a tension member and see FIG. 6), a lever 96 (an example of a movement part and see FIG. 6 to FIG. 8), a mounting plate 98 (an example of a mounting member and see FIG. 4, FIG. 7, and FIG. 8), and solenoids 99 (see FIG. 6).

<Locking Cover>

As illustrated in FIG. 4, the locking covers 92Y, 92C, 92M, and 92K are provided in correspondence to each toner container 70. The locking covers 92Y, 92C, 92M, and 92K serve as lids that are opened and closed when each toner container 70 is attached to and detached from the image forming apparatus body (that are opened by falling to the front side of the image forming apparatus 10). In the present embodiment, the locking covers 92Y, 92C, and 92M have the same shape and size, and the locking cover 92K has a wide shape in the apparatus width direction as compared with the locking covers 92Y, 92C, and 92M. This is caused by the shape of each toner container 70. When the locking covers 92Y, 92C, 92M, and 92K are not particularly needed to be distinguished from one another in the following description, they will be referred to as a locking cover 92.

Figure 9:
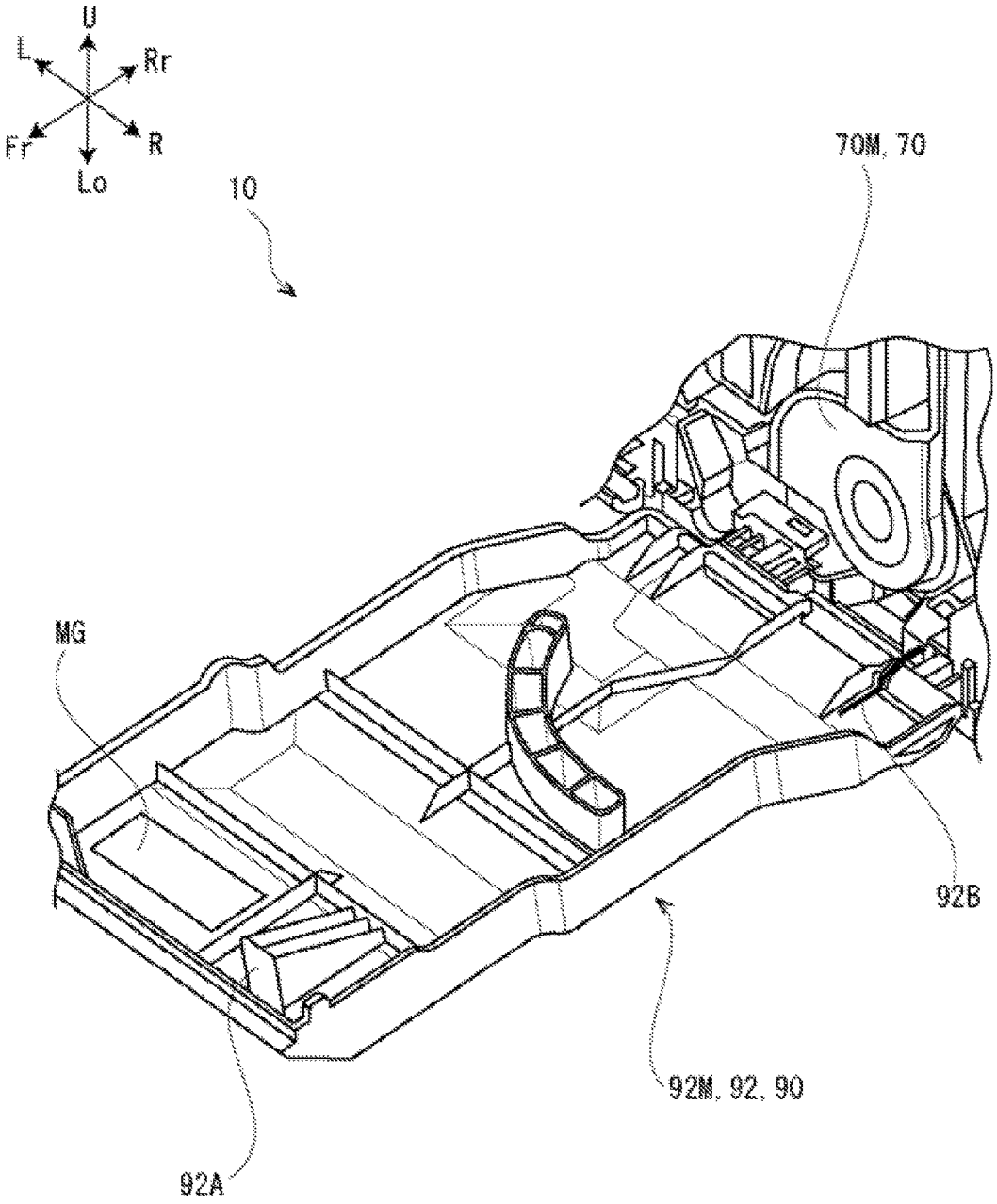
FIG. 9 is a view of a locking cover constituting a locking device of the present embodiment and a periphery thereof and is a perspective view of a state in which a locking cover is opened.
Figure 11:
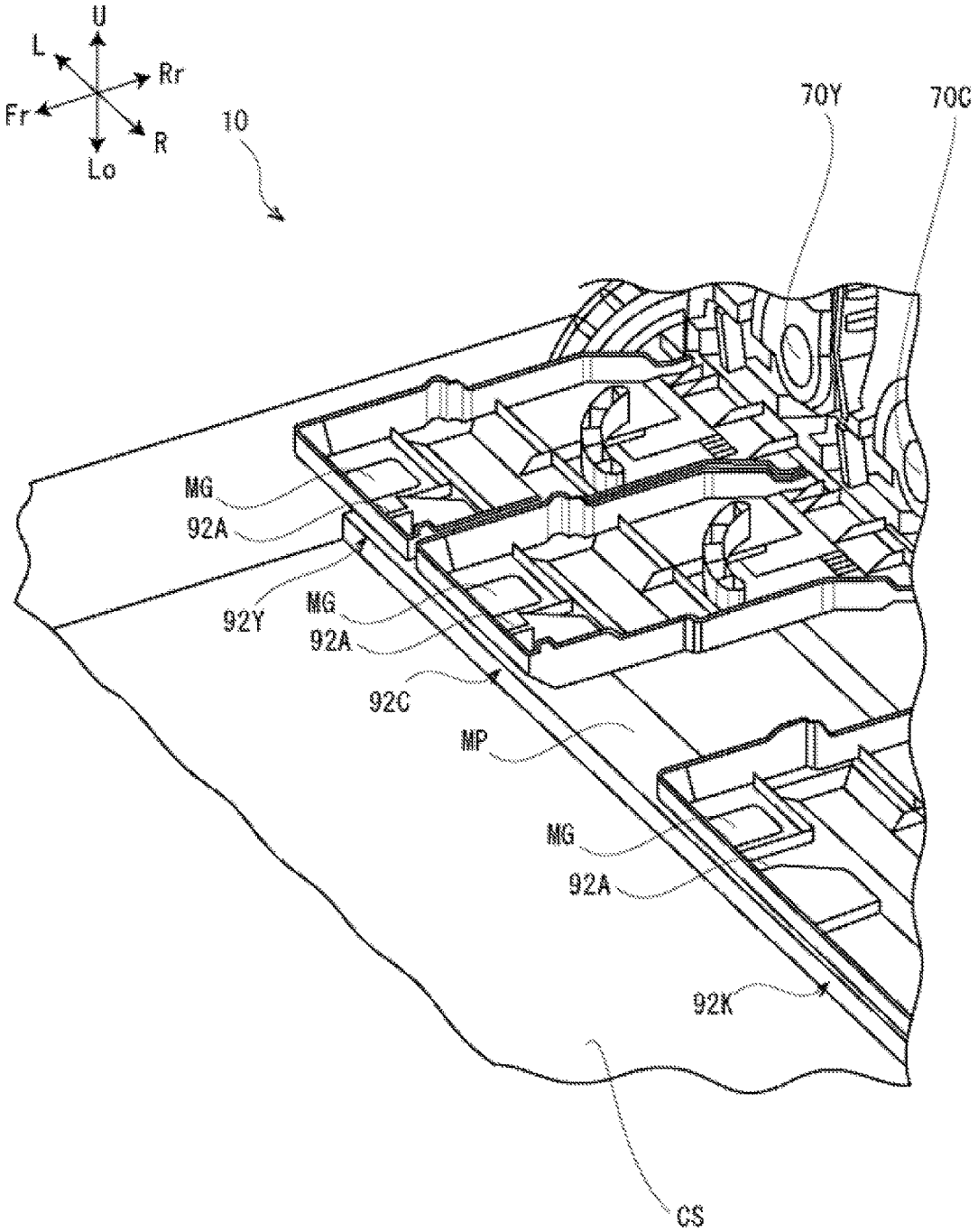
FIG. 11 is a view of an exterior cover and a locking cover constituting an image forming apparatus of the present embodiment and is a perspective view of a state in which the exterior cover and the locking cover are opened.

As illustrated in FIG. 9 and FIG. 11, a magnet MG is fixed to the back (the rear surface when viewed from the front side) of the locking cover 92. In states in which the locking cover 92 falls together with the exterior cover CS and is opened and closed, the magnet MG is configured to be arranged at a position facing the long sheet metal MP of the exterior cover CS while interposing the locking cover 92 between the magnet MG and the long sheet metal MP. In the state of FIG. 11, the magnet MG attracts the long sheet metal MP by magnetic force.

The locking cover 92 is provided with engaged parts 92A (see FIG. 9 and FIG. 11), which are engaged with the engagement parts 94Y, 94C, 94M, and 94K (see FIG. 6) which will be described later, in a state in which the locking cover 92 is closed (see FIG. 4). Two engaged parts 92A are provided to the locking cover 92K while one engaged part 92A is provided to each of the other locking covers 92Y, 92C, and 92M. As the engaged part 92A of the present embodiment, a hook-like member is used as an example.

At a connection part with the image forming apparatus body, which serves as an opening/closing fulcrum of the locking cover 92, a torsion coil spring 92B is arranged as illustrated in FIG. 9. The locking cover 92 is configured to be pressed by the torsion coil spring 92B so as to be easily opened at the time of opening.

<Engagement Part>

The engagement parts 94Y, 94C, 94M, and 94K have a function of engaging with the engaged parts 92A of each locking cover 92 in the state in which each locking cover 92 is closed (see FIG. 4). That is, the engagement parts 94Y, 94C, 94M, and 94K are provided in correspondence to the engaged parts 92A. Therefore, two engagement parts 94K (see FIG. 6) are provided while one engagement part 94Y, one engagement part 94C, and one engagement part 94M are provided. When the engagement parts 94Y, 94C, 94M, and 94K are not particularly needed to be distinguished from one another in the following description, they will be referred to as an engagement part 94. As the engagement part 94 of the present embodiment, a hook-like member, which is hooked to the engaged part, is used as an example. As illustrated in FIG. 6, each engagement part 94 is mounted at a part of the image forming apparatus body above each toner container 70, such as toner container 70M. Each engagement part 94 and a corresponding engaged part 92A are engaged with each other by hooking a nail toward the apparatus width direction.

<Tension Spring>

The tension spring SR has a function of pulling each engagement part 94 from the apparatus width direction left side (an example of a prescribed direction) (see FIG. 6). Each tension spring SR is hooked to a part of the image forming apparatus body above each toner container 70 and each engagement part 94 (see FIG. 6). In a state in which each tension spring SR pulls each engagement part 94 to the apparatus width direction left side, each tension spring SR is configured to allow each engagement part 94 to be engaged with the engaged part 92A of each locking cover 92.

<Lever>

The lever 96 has a function of moving each engagement part 94 to the apparatus width direction right side, thereby releasing the engagement state (the engaged state) between each engagement part 94 and the engaged part 92A of each locking cover 92.

As illustrated in FIG. 6, the lever 96 has a body part 96A, a plurality of first protruding parts 96B, and a second protruding part 96C. The body part 96A is a part following the apparatus width direction. The first protruding parts 96B are parts that protrude from the body part 96A in a direction crossing the apparatus width direction and contact with parts of each engagement part 94 at the apparatus width direction left side with the movement of the lever 96 to the apparatus width direction right side. That is, the first protruding parts 96B are provided in correspondence to each engagement part 94 in a plural number. The second protruding part 96C is a part that protrudes from the body part 96A in the direction crossing the apparatus width direction. As an example, the lever 96 is a member from which the body part 96A, the plurality of first protruding parts 96B, and the second protruding part 96C are formed by bending one wire. That is, the lever 96 of the present embodiment is integrally formed (see FIG. 6). The lever 96 is supported to a part of the image forming apparatus body above each toner container 70 so as to be movable in a prescribed range of the apparatus width direction (see FIG. 6).

Each of the first protruding parts 96B is arranged across each facing engagement part 94 in the apparatus width direction (see FIG. 6). Furthermore, each of the first protruding parts 96B is configured to contact with a part of each engagement part 94 at the apparatus width direction left side to press each engagement part 94 with the movement of the lever 96 to the apparatus width direction right side, thereby moving each engagement part 94, which is pulled to the apparatus width direction left side by the tension spring SR, to the apparatus width direction right side. As a consequence, the engagement state between each engagement part 94 and each engaged part 92A is released. The second protruding part 96C is arranged between the two engagement parts 94K for a K color (see FIG. 6).

<Mounting Plate>

Figure 5:
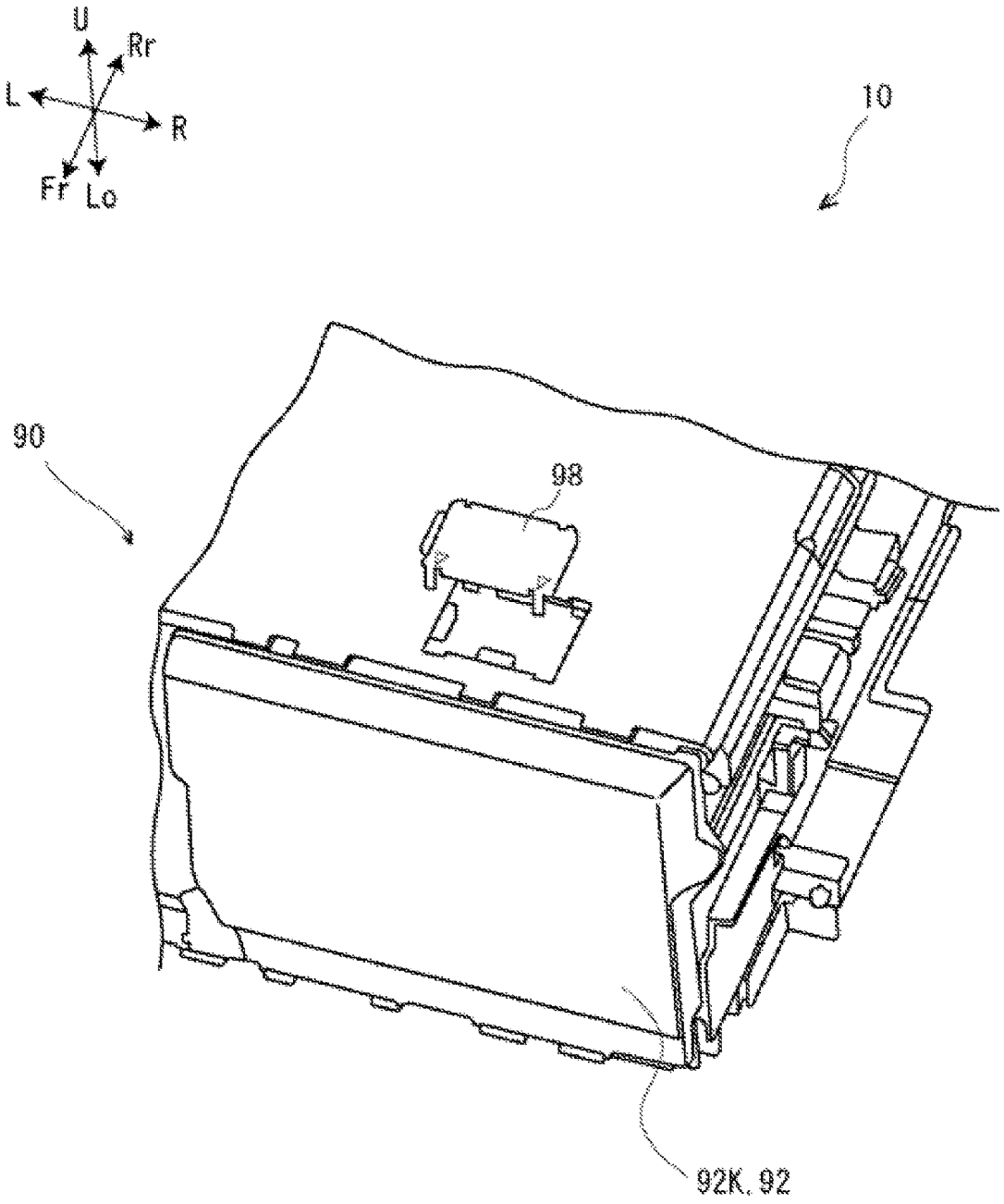
FIG. 5 is a view of a locking device for a K color of the present embodiment and is a perspective view of a state in which a locking cover is closed.
Figure 7:
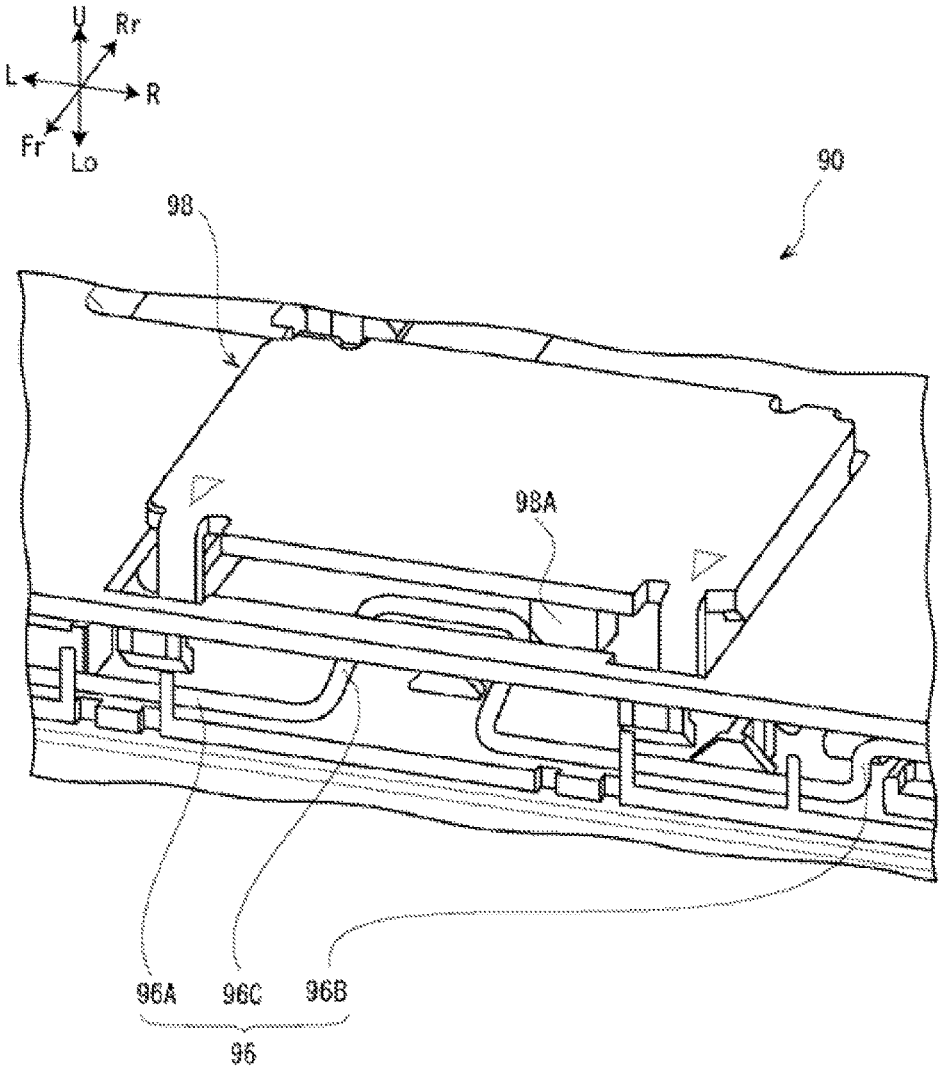
FIG. 7 is a view of a mounting member constituting a locking device of the present embodiment and a periphery thereof and is a perspective view of a mounting state at a first posture (a locked state).
Figure 8:
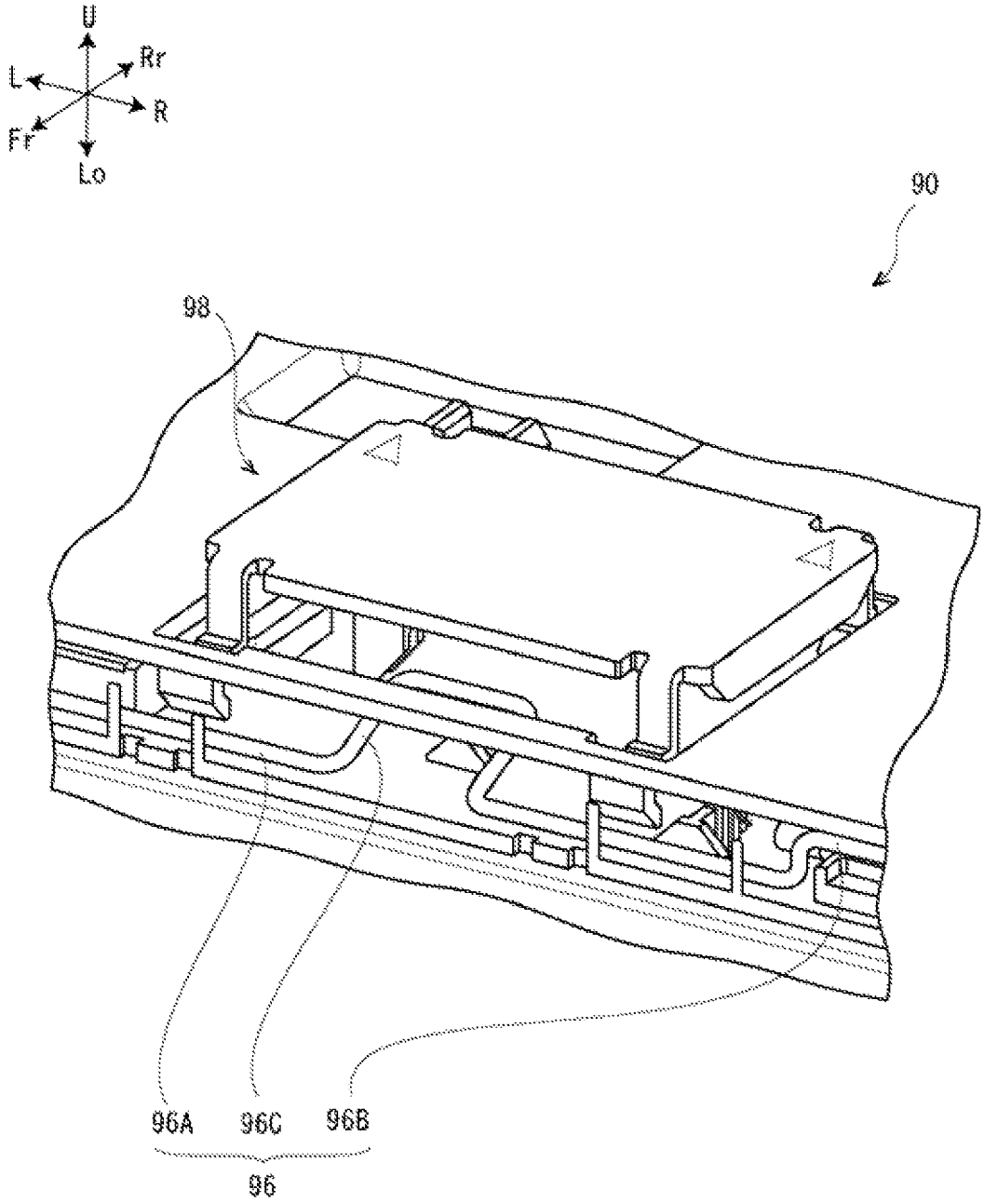
FIG. 8 is a view of a mounting member constituting a locking device of the present embodiment and a periphery thereof and is a perspective view of a mounting state at a second posture (an unlocked state).

As illustrated in FIG. 5, FIG. 7, and FIG. 8, the mounting plate 98 is a rectangular plate-like member and can be mounted at the image forming apparatus body at two postures. Specifically, as illustrated in FIG. 7 and FIG. 8, the mounting plate 98 is a part of the image forming apparatus body above the second protruding part 96C of the lever 96, and is configured to be mounted at a position overlapping the entire second protruding part 96C when viewed from the apparatus height direction. Furthermore, the mounting plate 98 has a function of limiting the movement of the lever 96 to the apparatus width direction right side so as to maintain the engagement state between each engagement part 94 and each engaged part 92A when the mounting plate 98 is mounted at one posture of the two postures, and permitting (not limiting) the movement of the lever 96 to the apparatus width direction right side so as to release the engagement state between each engagement part 94 and each engaged part 92A when the mounting plate 98 is mounted at the other posture.

As described above, the mounting plate 98 can be mounted at the image forming apparatus body at the two postures, wherein FIG. 7 illustrates a state (an assembled state) when the mounting plate 98 is mounted at the image forming apparatus body at a first posture (an example of the one posture) and FIG. 8 illustrates a state (an assembled state) when the mounting plate 98 is mounted at the image forming apparatus body at a second posture (an example of the other posture).

As illustrated in FIG. 7, the mounting plate 98 is provided at one face side thereof with a protrusion 98A. The protrusion 98A is formed at a position contacting with an edge of the second protruding part 96C at the apparatus width direction right side. Therefore, the protrusion 98A is configured to limit the movement of the lever 96 to the apparatus width direction right side. Actually, the lever 96 is slightly movable to the apparatus width direction right side, but its movement width (movement amount) is set to the extent that it is not possible to release the engagement state between each engagement part 94 and each engaged part 92A.

As illustrated in FIG. 8, when the mounting plate 98 is mounted at the image forming apparatus body at the second posture, even though the lever 96 moves to the apparatus width direction right side, there is no contacting member. Therefore, the movement of the lever 96 to the apparatus width direction right side is permitted, so that each of the first protruding parts 96B presses each engagement part 94 to move each engagement part 94 to the apparatus width direction right side with the movement of the lever 96 to the apparatus width direction right side. As a consequence, the engagement state between each engagement part 94 and each engaged part 92A is released.

<Solenoid>

The solenoids 99 are mounted at the image forming apparatus body above the toner container 70 (see FIG. 6). The solenoid 99 has a function of connecting to the engagement part 94 to move the engagement part 94 with a prescribed movement amount. In this case, the solenoid 99 is configured to be controlled by the control unit CU.

A distal end of a movable part of the solenoid 99 is mounted at the engagement part 94. Even though the mounting plate 98 is mounted at the first posture, when there is no toner in any toner container 70 (when it is a replacement time), that is displayed on the panel 86. Then, when a user performs an operation (an operation for replacing the toner container 70 with no toner) corresponding to the content displayed on the panel 86 with respect to the panel 86, since the solenoid 99 is energized by an instruction from the control unit CU and the movable part is sucked, the engagement part 94 is rotated around a rotation center (a reference numeral O of FIG. 6), so that the engagement between the engagement part 94 and the engaged part 92A is released. Then, when the user opens the exterior cover CS, the locking cover 92 corresponding to the toner container 70 with no toner is opened.

«Operation of Locking Device»

Next, the operation of the locking device 90 will be described with reference to the drawings. The following description will be given for a case where the mounting plate 98 is mounted at the image forming apparatus body at the first posture and a case where the mounting plate 98 is mounted at the second posture.

<When Mounting Plate is Mounted at First Posture>

In this case, each toner container 70 is mounted at the image forming apparatus body by a worker (a person who is not a user) until the image forming apparatus 10 is installed. After each toner container 70 is mounted at the image forming apparatus body, the worker mounts the mounting plate 98 at the image forming apparatus body at the first posture (see FIG. 7). By so doing, the movement of the lever 96 to the apparatus width direction right side is limited by the protrusion 98A of the mounting plate 98. Then, the worker closes each locking cover 92. By so doing, the engaged part 92A of each locking cover 92 is engaged with each corresponding engagement part 94. Then, the worker closes the exterior cover CS. As described above, when each toner container 70 is mounted at the image forming apparatus body, a user is not able to open each locking cover 92 locked by the locking device 90. That is, the user is not able to detach each toner container 70 from the image forming apparatus body.

<When Mounting Plate is Mounted at Second Posture>

In this case, the worker mounts the mounting plate 98 at the image forming apparatus body at the second posture (see FIG. 7) until the image forming apparatus 10 is installed. By so doing, the lever 96 is movable to the apparatus width direction right side without a limit by the protrusion 98A of the mounting plate 98. Then, each toner container 70 is mounted at the image forming apparatus body by the worker or the user. Then, the worker or the user closes each locking cover 92. By so doing, the engaged part 92A of each locking cover 92 is engaged with each corresponding engagement part 94. Next, the worker or the user closes the exterior cover CS. As described above, when each toner container 70 is mounted at the image forming apparatus body, the user, for example, can operate the panel 86 to release the engagement state between each engaged part 92A of each locking cover 92 unlocked by the locking device 90 and each corresponding engagement part 94. As a consequence, the user can detach each toner container 70 from the image forming apparatus body by opening the exterior cover CS and each locking cover 92.

«Effect»

Next, effects of the present embodiment will be described with reference to the drawings.

<First Effect>

As described above, when the mounting plate 98 is mounted at the image forming apparatus body at the first posture, a user is not able to detach each toner container 70 from the image forming apparatus body. Therefore, for example, it is possible to prevent each toner container 70 from being wastefully exchanged at a timing at which a toner remaining amount of each toner container 70 does not require exchange. On the other hand, when the mounting plate 98 is mounted at the image forming apparatus body at the second posture, the user, for example, can operate the panel 86 to easily detach each toner container 70 from the image forming apparatus body. In this regard, the locking device 90 of the present embodiment sets the two contrary functions as described above by the configuration and the mounting postures of the mounting plate 98 and the simple configurations of the lever 96 and the like.

Consequently, the locking device 90 of the present embodiment can set an engagement state (a locked state) and a releasable state (an unlocked state) by a simple configuration. Accordingly, in the image forming apparatus 10 of the present embodiment, for example, an increase in running cost in the image formation due to exchange of the toner container 70 at an unnecessary timing is suppressed.

<Second Effect>

As described above, in the case of the present embodiment, the magnet MG is fixed to the back (the rear surface when viewed from the front side) of each locking cover 92 as illustrated in FIG. 9 and FIG. 11. In the states in which the locking cover 92 falls together with the exterior cover CS and is opened and closed, the magnet MG is configured to be arranged at a position corresponding to the long sheet metal MP of the exterior cover CS while interposing the locking cover 92 between the magnet MG and the long sheet metal MP.

Consequently, in the case of the present embodiment, in a state in which the engaged part 92A of each locking cover 92 is not engaged with each engagement part 94, when the exterior cover CS is opened, each locking cover 92 is also opened by magnetic force together with the exterior cover CS.

As described above, the present embodiment has been described as an example; however, the technical scope of the present disclosure is not limited to the present embodiment.

What is claimed is:

1. A locking device comprising:

a locking cover that is opened and closed when a toner container for receiving toner to be replenished to a development device for developing a toner image is attached to and detached from an image forming apparatus body;

an engagement part that is engaged with the locking cover when the locking cover is in a closed state;

a tension member that pulls the engagement part from a prescribed direction, thereby allowing the engagement part to be engaged with the locking cover;

a movement part that moves the engagement part in an opposite direction of the prescribed direction, thereby releasing an engagement state between the engagement part and the locking cover; and a mounting member that is mountable at the image forming apparatus body at two postures, and limits movement of the movement part to the opposite direction so as to maintain the engagement state when the mounting member is mounted at one posture while permitting the movement of the movement part in the opposite direction so as to allow the engagement state to be releasable when the mounting member is mounted at a remaining one posture.

2. The locking device of claim 1, wherein the movement part has a body part following the prescribed direction, a first protruding part protruding from the body part in a direction crossing the prescribed direction and contacting with a part of the engagement part at a side of the prescribed direction, and a second protruding part protruding from the body part in the direction crossing the prescribed direction, the mounting member has a plate shape and is provided at one face side thereof with a protrusion, and when the mounting member is mounted at the one posture, the protrusion contacts with the second protruding part to limit the movement of the movement part in the opposite direction, and when the mounting member is mounted at the remaining one posture, the movement of the movement part in the opposite direction is permitted, so that the first protruding part moves the engagement part in the opposite direction with the movement of the movement part in the opposite direction and thus the engagement state is releasable.

3. An image forming apparatus comprising:

the locking device of claim 1;

a formation unit that includes a development device for developing a toner image and forms the toner image on a medium;

a toner container that receives toner to be replenished to the development device; and a fixing device that fixes the toner image, which is formed on the medium, to the medium.

4. The image forming apparatus of claim 3, wherein a magnet is fixed to the locking cover, the image forming apparatus body is provided with an exterior cover that is opened and closed at a front side of the locking cover and has a magnetic material fixed thereto, when the exterior cover is opened in a state in which the engagement state is released, the locking cover is moved to open by magnetic force between the magnet and the magnetic material with movement of the exterior cover.

* * * * *